US005496071A

United States Patent [19]

Walsh

[11] Patent Number: 5,496,071

[45] Date of Patent: Mar. 5, 1996

[54] METHOD OF PROVIDING ARTICLE IDENTITY ON PRINTED WORKS

[76] Inventor: Margaret A. Walsh, 65 South St., Apt. 111, Auburn, N.Y. 13021

[21] Appl. No.: 469,509

[22] Filed: Jun. 6, 1995

Related U.S. Application Data

[63] Continuation of Ser. No. 100,151, Aug. 2, 1993, abandoned.

[51] Int. Cl.[6] ..... B42D 15/00

[52] U.S. Cl. ..... 283/70; 283/74; 283/117

[58] Field of Search ..... 283/70, 74, 79, 283/81, 60.1, 62, 36, 117

[56] References Cited

U.S. PATENT DOCUMENTS

| | | | |
|---|---|---|---|
| 4,272,327 | 6/1981 | Logan | 283/62 X |
| 4,549,750 | 10/1985 | Stone et al. | 283/81 X |
| 5,083,816 | 1/1992 | Folga et al. | 283/36 X |
| 5,241,671 | 8/1993 | Reed et al. . | |
| 5,249,827 | 10/1993 | Olson | 283/81 X |

OTHER PUBLICATIONS

Ref. A, "Official Gazette", 1 page.
Ref. B, "The Washington Post", 1 page.

*Primary Examiner*—Mark Rosenbaum
*Assistant Examiner*—Khan V. Nguyen
*Attorney, Agent, or Firm*—Nixon & Vanderhye

[57] ABSTRACT

The objective of the invention is to an identity format provided in each article for enabling search and classification. In a mass distributable print media containing at least one page and a plurality of articles on the page, each article including a title and related text, an improvement includes a range of elements including but not limited to a relative subject matter index number, complete date of publication and publisher name for the print media arranged closely adjacent each article. All or some of these elements may be supplemented by machine readable code such as a bar code. Publishers of newspapers, magazines and the like have not heretofore provided these elements on every article. With these elements in place on every article, the invention teaches and provides users the options to physically read and clip information and/or electronically search and print-out information via proactive and reactive searching ways from existing data bases which have relatively indexed numbers with reasonably good match-ups to individual interest. Furthermore, these elements can act either independently of, or in collaboration with each other to produce new revenues for publishers and/or clipping services by supplying information to subscribers, thus allowing customized news delivered by FAX, electronic mail, regular mail, microfilm, video, television or other peripheral devices.

8 Claims, 1 Drawing Sheet

METHOD OF PROVIDING ARTICLE IDENTITY ON PRINTED WORKS

This is a continuation of application Ser. No. 08/100,151, filed Aug. 2, 1993, now abandoned.

BACKGROUND AND SUMMARY OF THE INVENTION

The present invention relates to a concise and precise printed format providing ever-changeable literary, numerical and encoded parts to identify articles of printed works in newspapers, magazines and the like. In general, the basic elements in the format may include a variety of contents and arrangements. For example, a preferred format may consist of: (a) a complete date and a relative subject index number in both ordinary numerical or alpha-numerical and encoded form; (b) the name of the writer or source of the article; and (c) the name of the publication containing the article. The format can be read manually or electronically. Unlike television or radio, which is only seen and heard, this novel idea offers the file-builder the option to manually clip and file or electronically scan and store articles of printed works.

Heretofore, the writer's name or source of the article and the publisher of an article may have been known and shown, but the combination of the writer's name or source of the article and the publication name were not linked together with a complete date and a relative subject index number on every article appearing in the publication. Since objects like newspaper articles can be gathered together into classes, the challenge is to separate like objects from unlike objects based upon their individual characteristics. This invention identifies and classifies articles of printed works by, at a minimum, the author and publication. It is preferred however, to also include a complete date and a relative subject index number. This combined classification unambiguously identifies every article of printed works. Furthermore, the methodology herein serves to educate our youth in library skills and practices, and teaches a system of how to collect and build a personal reference file of knowledge.

To the best of my knowledge, no prior article identification system as described herein exists, based upon my following findings:

(A) In museums and libraries, spanning 153 years of newspaper and magazines, my study and analysis show no indication of this invention ever being in practice;

(B) Concurrently, my research led to a study of magazines. Here I found that some magazines had a date and publication name on the bottom of each page. However, no identity was noted on the article itself, and the articles did not make any reference to a relative subject index numbering system;

(C) Thirty-nine current U.S.A. newspapers from nine states and from coast-to-coast and border-to-border, plus five foreign newspapers from Canada, England, France, Germany and Italy were completely void of an article-by-article dating and relative subject indexing number system; and (D) Just by coincidence, two recent television programs, "60 Minutes" and "CBS Evening News", showed an isolated and undated newspaper article which had to be supported and reinforced by the publication's masthead and masthead's date to prove a relationship existed between the article and masthead. It took this two-step process to prove their point. There still leaves a doubt in the viewer's mind that the article truly came from that specific masthead but to further prove it would be very timely and costly.

This invention provides a tool to a very large number of people who desire to construct personal files in every imaginable field of human endeavor by clipping or copying articles from newspapers, magazines, journals and other printed works, and/or by electronically accessing such information from available data bases. These works, with an array of personal topics, can be relatively indexed with reasonably good match-ups to individual interest of students, housewives, scientists, engineers, librarians, writers, lawyers, office workers and so on, to maintain private (physical or electronic) files so as to keep track of events, developments, persons and etc. Such files provide a compact store of documents that can be organized to meet the needs of individuals, small organizations, small businesses, small libraries or even a laboratory. Files are organized in various ways, for example, by a date or a broad subject name; alternatively, an index is developed using one or more of the systematic descriptive bibliographic elements that are used in documentation to identify items on file.

The date of publication of a document is one of the identifying elements that is universally employed to file and locate documents. Publishers of newspapers, magazines and the like have not addressed the needs of file builders, nor have they provided means for these people to have a complete and accurate date and/or relative subject index classification number on every article.

Newspapers, magazines and the like carry a number of entries to identify the year, volume, issue, date and etc. However, the individual items comprising these published works, do not have associated with each sufficient bibliographic information to precisely identify each from the moment it takes on a separate existence of its own when it is clipped from the page in which:

(A) it appeared at the time of original publication; or (B) when it is copied to become a new document; or (C) when a unit of information is separated from other items on a page of the original document.

In nearly all cases the complete date of publication is lost unless that complete date is entered manually on the clipping or photo-copy. That action, if it is remembered at all, is subject to human error. An undated or erroneously dated clipping or copy loses much of its value.

"Finding" or identifying information of some kind is always associated with each article in printed works. The identifying information may include descriptive title, the source, place of publication, author's name(s), affiliation of the author(s), etc. The date of publication is almost always absent. The importance of the date of publication in filing, organizing and locating material of interest is well recognized by librarians, archivists and documentalists. This invention introduces into the world of publication, the use of the publication date as a key piece of information in a format that associates it with each article. A variety of formats are proposed that provide a small and dedicated area, preferably but not necessarily at the front end or beginning of each article. The preferred format will include the publication's complete date as an integral part of the article, and associated with other identifying information. More specifically, each article will, consist of a unit comprising the verbal and/or graphic message(s) with its own identifying information including the publication's complete date, the author's name and a relative subject index classification number. For enabling electronic reading of all or part of the information, a machine readable code (such as a bar code) may be provided.

While the format including all of the above noted information is preferred, it will be appreciated that the invention encompasses formats which include a range of information for each article as follows:

1) author name and publisher name;

2) author name, publisher name and complete date;

3) author name, publisher name and relative subject index number; and 4) author name, publisher name, complete date and relative subject matter index number. All of the above may be supplemented by machine readable code.

With present day computer and photo-based composing technology, creating a flexible format to include the publication's complete date and an encoded relative subject index number with every article is inexpensive and within the reach of all publishers. The publication's complete date may be printed in ordinary numerical form or in alpha-numerical form. The font selected may be designed for easy manual reading and machine reading (employing character recognition technology). Digital data can be generated directly from the date record and other elements of the article's relative subject index number for entry into a computer based index. The publication date may also be encoded in a variety of ways such as bar codes, diffractional patterns and the like which would be generated by computer and printed as machine readable characters in the area dedicated to the identifying information.

I have found, as a general rule and practice, there are two, but not limited to two, relative classifications systems such as:

(A) the internationally recognized Dewey Decimal Classification (DDC) which is used in personal and small public libraries:

(B) and the United States Library of Congress Classifications (LCC) which is used by large general libraries, small public libraries and special libraries. Both the (DDC) and (LCC) systems are up-dated frequently to provide provisions for new subjects and latest terminology; plus anticipate fundamental changes.

The subject index number in the format will be assigned by the publisher or writer-classifier and originate from DDC, (LCC) or like indexing system. However, for present day cost-effective and practical reasons, but not limited in scope as to how many subject index numbers and digits may be used in a system, this invention now teaches that a three digit subject index number, without subdivision numbers, is doable now. One typical way the writer can generate a subject index number is:

(A) Determine the subject's name or theme of the article.

(B) Now, using the (DDC)'s alphabetical table of "Relative Indexes" by subjects, seek out the best match-up between the subject's name and the relative subject index number.

(C) Now, armed with the best relative subject index number, that is thought to be the best match-up between the subject's name and the index number from the alphabetical table, the last step is to verify the above index number with the "Third Summery" Section of a (DDC) reference book which contains 999 relative subject index numbers. With 999 subjects to "call-on" or "call-up", this reduced (DDC) system provides enough relative subject index numbers for small collections. However, the writer-classifier and the file-builder have the option to further subdivide classes, by adding more digits, to fit their needs. Once the relative subject index number and its encoded form appears in the format, it can be read manually and/or electronically by the user. Further details can be referenced in the TWELFTH Abridged. Edition of the (DDC) book published by the Forest Press Inc., Lake Placid, N.Y.

With these in-place library tools and existing computer developments, the introduction of a format in accordance with this invention into newspapers, magazines and the like, that associates the publication's complete date with each article, will allow one to generate computer-based indexes with the publication date serving as a vital component linking the index number with the document store which may be based on paper, microfilm or video media. This gathering of article identity and information is not limited to just printed works but also electronic works generated by electronic newspapers or television (or by scanning printed works into an electronic data base) which can be accessed through modems by computer users.

With regard to electronic publishing, it should also be noted that this invention may be incorporated into the Standard Generalized Markup Language (SGML) currently being developed by publishers. This is a standardized format for labeling various elements in an electronic document to facilitate indexing, searching, etc.

The potential uses of this invention are varied. For example, publishers can generate revenues and provide a community service as follows:

1. Since publishers and their affiliates own what they print, they can develop a regional in-house electronic clipping service each month to organizations who need article documentation and subject trend analysis. Typical users of this personalized service would be:

a. Municipalities (City/County/State).

b. Institutions (Colleges/Hospitals/Banks).

c. Libraries (Public/College/Private).

d. Businesses (Tourism/Realtors/Car & Boat Dealers and etc).

2. A private company (not a publisher) could also perform a similar clipping service to the above sales targets providing all parties (Publisher+Clipper+ Buyer) adhere to copyright laws.

3. Revenues can also materialize through custom index numbers generated for advertizers of display and to track and correlate sales category-by-category and subdivisions like footwear (Girls/Boys/Ladies/Men) or computer goods and its wide range of subdivisions.

4. The invention serves to educate youth in library skills and practices, and teaches a system of how to collect and build a personal reference file of knowledge. This on-going process exists between the Article-Writer-Classifier and the Article-File-Builder by interacting with the format's elements to focus upon the joint mission to unambiguously identify articles of printed works. Since "Knowledge is Power" (Sr. Francis Bacon/1605), this invention will further prepare students to live in the information age.

5. Unlike television or radio, which is briefly seen and heard, this invention provides the publisher's general readership the option to manually clip and file or electronically scan and store accurately identified articles of printed works.

6. Also, the publishers themselves can save money in-house by eliminating manual clipping systems which would save time and save the space occupied by the back issues, sub-files and clutter.

In its broader aspects, therefore, the present invention relates to a mass distributable print media substrate containing at least one article on a page, the at least one article including a title and related text, the improvement comprising printed information including at least the author and publication name in close proximity to the at least one article.

In its preferred form, the printed information also includes the complete publication date and a relative subject matter index number, along with machine readable encoding.

Additional objects and advantages will become apparent from the detailed description which follows.

DETAILED DESCRIPTION OF THE DRAWINGS

Figure 1:
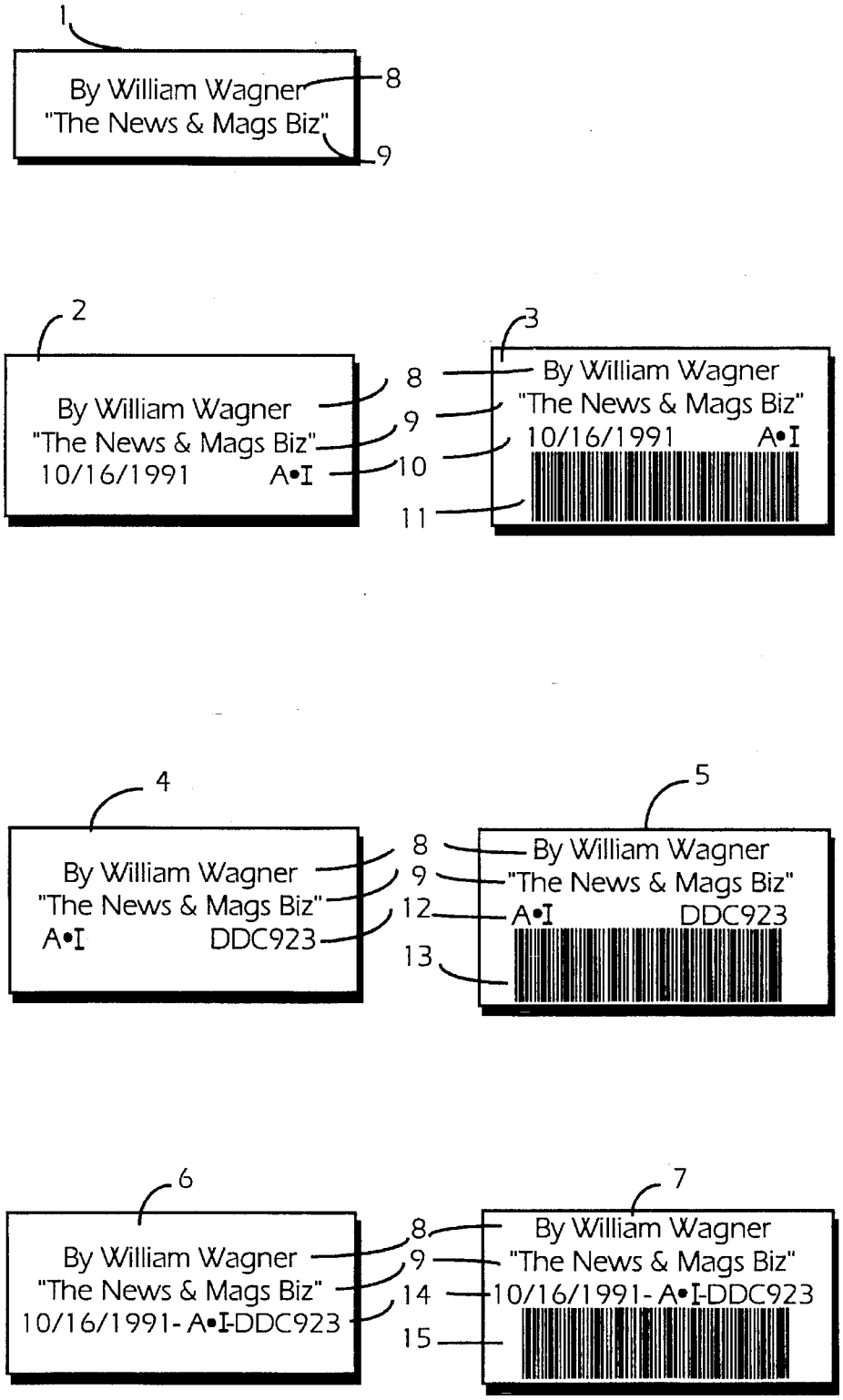
FIG. 1 illustrates a group of seven rectangular formats (but not limited to seven, nor to a rectangular design) exhibiting a variety of contents and arrangements which lend clarity to the identity of printed works.

With reference to FIG. 1, seven alternative formats for identifying articles in printed works are shown. In each, reference numerals are employed as follows:

a. All [8'] refer to the name of the writer or source of the article;

b. All [9'] refer to the publication (publisher) name;

c. The [10] refers to a combination line consisting of the complete date and an A.I™ mark to indicate origin of the service;

d. The [11] refers to a bar code for the complete date and A-I™;

e. The [12] refers to a combination line consisting of the DDC relative subject index number and A.I™;

f. The [13] refers to a bar code for the A.I™ and the DDC relative subject index number.

g. The [14] refers to a combination line consisting of the complete date, A.I™ and the DDC relative subject index number; and h. The [15] refers to a bar code for the complete date, A-I™ and the DDC relative subject index number.

In the first format, the author or writer's name 8 is shown above the publisher name 9. This information would typically appear just below the title of the article, in the space between the article name and the article itself. The information may be enclosed in a "box" as shown but it need not be so enclosed.

In the second format, additional information 10 is provided in the form of the complete date of the article along with a trademark or service mark indicating the origin of the service.

In the third format, information over and above that which is included in the second format is provided in the form of a bar code 11 which permits electronic reading of the information otherwise referred to by reference numeral (and, optionally, the information referred to by reference numerals 8 and 9 as well).

In the fourth format, items of information 8 and 9 correspond to the information provided in format 1, and in addition, a DDC code 12 is provided along with the service mark.

Format 5 is similar to format 4 with the exception that a bar code 13 is added to permit machine reading of the information otherwise indicated by reference numeral 12 (and, optionally, reference numerals 8 and 9), In format 6, items of information 8 and 9 are provided in the manner illustrated in format 1 and, in addition, information 14 is provided in the form of a complete date, a service mark, and the DDC relative subject index number.

Format 7 is similar to format 6 with the exception that a bar code 15 is added which enables machine reading of the information otherwise designated by reference numeral 14 (and, optionally, reference numerals 8 and 9).

The drawings and designs herein show exemplary format(s) and it will be appreciated that the invention is not limited in content and arrangement to the specific examples shown. The appearance can be rectangular, oval and the like and, as already noted, with or without and the like and, as already noted, with or without borders. The width shown herein is approximately two inches so as to fit a currently conventional two inch wide newspaper and magazine columns, but the arrangement may be varied as desired. Since the column height represents true space and conspicuous consumption of area, the drawings show three and four line comparisons. The three line format shows it would be adequate for manual reading and clipping now. The four line format shows an alpha-numerical bar code which offers the file-builder the option to manually clip and file or electronically scan and store articles of printed works with clear identity.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A method of generating identification information for enabling search and classification of each of a plurality of articles printed on a page of a mass distributable print media comprising the steps of:

obtaining identification information including author name, publisher or publication name, complete date of publication for said print media and subject matter index number for each article; and printing said identification information on said page of said print media in close proximity to each of the respective plurality of articles.

2. The method of claim 1 wherein said identification information is arranged between a title and associated text of the respective articles.

3. The method of claim 1 and including the step of providing a machine readable code adjacent said identification information enabling machine reading of at least some of the identification information.

4. The method of claim 1 wherein said print media comprises a newspaper or magazine.

5. The process of claim 1 wherein each said article further includes a code enabling machine reading of the identifying information.

6. A method of generating identification information for enabling search and classification of each of a plurality of articles printed on a page of a mass distributable print media comprising the steps of:

obtaining identification information including a relative subject matter index for each article and a complete date of publication for said print media; and printing said identification information on said page of said print media in close proximity to each of the respective plurality of articles.

7. The method of claim 6 wherein said print media comprises a newspaper or magazine.

8. The process of claim 6 wherein each said article further includes a code enabling machine reading of the identifying information.

* * * * *